US006386103B1

(12) United States Patent
Charette et al.

(10) Patent No.: US 6,386,103 B1
(45) Date of Patent: May 14, 2002

(54) BLANKET TUBE REMOVAL DEVICE

(75) Inventors: William Albert Charette, Rollinsford, NH (US); Christian Heinz Miescher, Newburgport, MA (US); David Crowell Emery, York, ME (US); Charles Henry Dufour, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/540,790

(22) Filed: Mar. 31, 2000

Related U.S. Application Data

(63) Continuation-in-part of application No. 09/425,328, filed on Oct. 22, 1999, now Pat. No. 6,250,223.

(51) Int. Cl.[7] ..... B41F 27/00; B25B 7/00; B25B 27/06

(52) U.S. Cl. ..... 101/375; 101/479; 29/280; 29/282; 29/895.23; 81/418; 81/426.5; 81/427.5

(58) Field of Search ..... 101/216, 217, 101/375, 376, 479; 29/278, 280, 282, 895.23, 268; 81/418, 426.5, 427.5; 294/16, 28, 118, 100, 116

(56) References Cited

U.S. PATENT DOCUMENTS

| | | | | | |
|---|---|---|---|---|---|
| 341,473 | A | * | 5/1886 | Green | 294/118 |
| 630,107 | A | * | 8/1899 | Rayl | 294/100 |
| 1,355,481 | A | * | 10/1920 | Lee | 29/895.23 |
| 1,439,202 | A | * | 12/1922 | Taylor | 294/28 |
| 1,468,344 | A | * | 9/1923 | Eckert | 294/118 |
| 1,574,349 | A | * | 2/1926 | Johanson | 294/28 |
| 4,005,893 | A | * | 2/1977 | Tash | 294/118 |
| 4,030,415 | A | * | 6/1977 | Fellows | 101/382.1 |
| 4,461,663 | A | * | 7/1984 | Tachibana et al. | 101/375 |
| 4,823,693 | A | * | 4/1989 | Kobler | 101/375 |
| 4,913,048 | A | | 4/1990 | Titgemeyer | 101/141 |
| 5,108,140 | A | * | 4/1992 | Bartholet | 294/115 |
| 5,309,797 | A | | 5/1994 | Nguyen | 81/64 |
| 5,323,702 | A | | 6/1994 | Vrotacoe et al. | 101/217 |
| 5,429,048 | A | | 7/1995 | Gaffney et al. | 101/217 |
| 5,476,298 | A | * | 12/1995 | Etamadian | 294/115 |
| 5,802,975 | A | * | 9/1998 | Prem et al. | 101/375 |

FOREIGN PATENT DOCUMENTS

| | | |
|---|---|---|
| DE | 2542748 | 4/1976 |
| DE | 4341246 | 2/1995 |
| EP | 0053791 | 6/1982 |
| GB | 461780 | 2/1937 |

* cited by examiner

*Primary Examiner*—Stephen R. Funk
(74) *Attorney, Agent, or Firm*—Davidson, Davidson & Kappel, LLC

(57) ABSTRACT

A printing sleeve removal device includes a first jaw arm and a second jaw arm movable with respect to the second jaw arm, the first and second jaw arms having ends forming a jaw to engage a printing sleeve. Also disclosed is a method for removing a printing sleeve comprising engaging a printing sleeve on a printing cylinder with a first jaw arm and a second jaw arm and moving the printing sleeve via the first and second jaw arms so as to slide the printing sleeve axially with respect to the printing cylinder.

6 Claims, 13 Drawing Sheets

BLANKET TUBE REMOVAL DEVICE

This application is a continuation-in-part of U.S. patent application Ser. No. 09/425,328, filed Oct. 22, 1999, now U.S. Pat. No. 6,250,223, which is hereby incorporated-by-reference herein.

BACKGROUND OF THE INVENTION

1. Field of the Invention

The present invention relates generally to printing presses and more particularly to a method and device for removing a tubular blanket or tubular plate from a respective printing press cylinder.

2. Background Information

U.S. Pat. No. 5,429,048 to Gaffney et al. discloses an offset lithographic printing press in which a web of material to be printed passes through a series of print units. Each of the print units has a plate cylinder, a blanket cylinder and an impression cylinder, which may be a second blanket cylinder. A flat printing plate containing an image may be fastened to the plate cylinder. A gapless tubular-shaped blanket may be fastened to the blanket cylinder. A frame of the printing unit supports the plate and blanket cylinders. A portion of the frame adjacent one axial end of the blanket cylinder is moveable in order to provide an opening in the frame so as to provide access to one end of the blanket cylinder. The tubular printing blanket, which is replaceable, may be moved axially through the opening in the frame. U.S. Pat. No. 5,429,048 also discloses that the blanket cylinder interior has passages for communicating air to the outer peripheral surface of the blanket cylinder. Air pressure applied to the interior of the blanket cylinder is thus communicated to the interior of the blanket to expand the blanket as the blanket is inserted onto the blanket cylinder. After the blanket is placed over the blanket cylinder, the air pressure may be removed. The blanket then contracts around the blanket cylinder and tightly engages and grips the blanket cylinder. To remove the blanket, air pressure is again applied to enable the blanket to be manually moved off the blanket cylinder.

A problem with the above-mentioned printing press is that the inner surface of the blanket, or the outer surface of the blanket cylinder may become contaminated. For example, sticky substances such as printing inks inadvertently may become attached to the inner surface of the blanket. When an operator attempts to remove the blanket from the blanket cylinder by providing air pressure to the inner surface of the blanket and sliding the blanket off axially, the sticky substances may prevent easy removal. Likewise, manufacturing imperfections or environmental conditions such as humidity and temperature can cause the blanket to be difficult to remove.

U.S. Pat. No. 4,913,048 to Tittgemeyer discloses a printing press with a sleeve-shaped gapless printing form or plate which may contain an image. This sleeve-shaped printing form is axially removable over the plate cylinder. The sleeve-shaped printing form may be fastened to the plate cylinder by expanding the form with pressure from a pressure medium. The sleeve-shaped printing form is then moved manually over the plate cylinder and allowed to relax.

This type of printing press with axially removable printing forms may suffer from the same problems as that disclosed in U.S. Pat. No. 5,429,048.

BRIEF SUMMARY OF THE INVENTION

An object of the present invention is to provide a device to aid in the axial removal of blankets or other types of printing sleeves. An additional or alternative object is to provide a method for axially removing blankets or other types of printing sleeves.

The present invention provides a printing sleeve removal device to aid in removing of a printing sleeve.

In one embodiment, the present invention provides a printing sleeve removal device having a first jaw arm and a second jaw arm pivotable with respect to the second jaw arm, the first and second jaw arms having ends forming a jaw to engage a printing sleeve.

Advantageously, the device may be insertable through an opening in the printing press so that an operator can use the device to remove the printing sleeve. This aids in quick and simple application of the device and permits an operator to remove a blanket or other type of printing sleeve.

The ends advantageously may be provided with gripping pads to aid in friction.

In one embodiment, the jaws may be tightened by moving two handles of the arm toward each other, the handles being on the jaw arms opposite the ends. This embodiment creates a simple and convenient mechanical sleeve removal device.

In another embodiment of the present device, the jaws may be tightened with the aid of a motor, preferably by rotating a toothed gear which forces the jaw shut.

The present invention is particularly applicable to axially removable blankets of the type described in U.S. Pat. Nos. 5,429,048 and 5,323,702, which are hereby incorporated by reference herein. The compressibility of the outer layer of the blanket provides a firm grip on the blanket for the device, without necessarily squeezing the innermost tube of the blanket, which could create disadvantageous friction between the innermost tube and the blanket cylinder. This friction could make removable of the blanket more difficult. It may be desirable to have the printing sleeve removal device clamp and pull on the sleeve as opposed to the rubber blanket on the sleeve in order to not damage the blanket surface or to get at a slightly smaller diameter.

Preferably, the jaw engages the outer surface of the printing sleeve. An alternative is to have the printing sleeve tube extend past the cylinder body end and have the jaw expand inside the tube to create the frictional force on the inside of the tube and then remove accordingly.

In another embodiment, the present invention provides a printing sleeve removal device operating on a gear side of the printing sleeve, the removal device including a clamp for engaging the gear side of the printing sleeve and an actuator connected to the clamp to move the clamp and the printing sleeve axially away from the gear side.

The present device also may be used with other types printing sleeves, such as the tubular printing forms described in U.S. Pat. No. 4,913,048, which is also hereby incorporated by reference herein.

In yet another embodiment, the present invention provides a printing sleeve removal device comprising at least one band for wrapping around at least part of a printing sleeve and a tightening device connected to at least one band for tightening at least one band.

Advantageously, at least one band of the printing sleeve removal device includes a first semicircular band and a second semicircular band. More than one band and/or tightening device can be included to provide balanced pulling force on the printing sleeve. This would in turn minimize any tendency to bind as the printing sleeve is removed. These bands may be connected at one end by the tightening device and at their other ends by a second tightening device, so that the removal device is in a circular shape which can be placed axially over the printing sleeve. This form aids in quick and simple application of the device and permits an operator to remove a blanket or other type of printing sleeve.

Each tightening device may comprise a first side plate and a second side plate, the two side plates supporting a first pin and a second pin. The pins preferably are non-rotatably fixed to the side plates, and one of the first pin and the second pin is attached to an actuating rod. One end of the first band is attached rotatably to the first pin and an end of the second band is attached rotatably to the second pin.

By twisting a handle on the actuating rod of at least one of the tightening devices, the tightening device twists so the effective diameter of the circle formed by the first and second semicircular bands is reduced. Preferably two tightening devices are actuated to reduce the effective diameter. As a result, when the removal device is placed over a printing sleeve and the tightening devices are actuated, the sleeve may be firmly grasped and axially removed.

The embodiments of the present invention form an effective way for removing printing sleeves. The sleeve may be grasped more firmly than by hand.

A lip or slightly larger diameter may be located on the end of the printing sleeve. This lip allows the sleeve removal device to reduce diameter and pull directly on the lip as opposed to relying on frictional clamping force.

The present invention also provides a method for axially removing a printing sleeve comprising placing a sleeve removal device over the printing sleeve, tightening the sleeve removal device so as to grasp the sleeve, and axially pulling on the removal device so as to axially remove the printing sleeve. This method provides a safe and effective way to remove printing sleeves.

Advantageously, the above method further includes providing air pressure to an inner surface of the printing sleeve. Moreover, the above method preferably is used with a sleeve which is a blanket in an offset printing unit. The tightening step then may include tightening the sleeve removal device so as to compress a compressible layer of the blanket. An inner tube of the sleeve thus advantageously may remain unaffected by the removal device.

The present device need not be used for every blanket removal. A press operator may first attempt to remove a blanket manually, and determine if the blanket sticks. If so, the operator utilizes the removal device. The present invention therefore also advantageously includes a method of axial removal of a printing sleeve comprising attempting to manually remove a printing sleeve axially, determining that the sleeve cannot be manually removed, placing a sleeve removal device over the printing sleeve, tightening the sleeve removal device so as to grasp the sleeve, and axially pulling on the removal device so as to axially remove the printing sleeve

BRIEF DESCRIPTION OF THE DRAWINGS

The present invention is described below by reference to the following drawings,in which.

DETAILED DESCRIPTION

Figure 1:
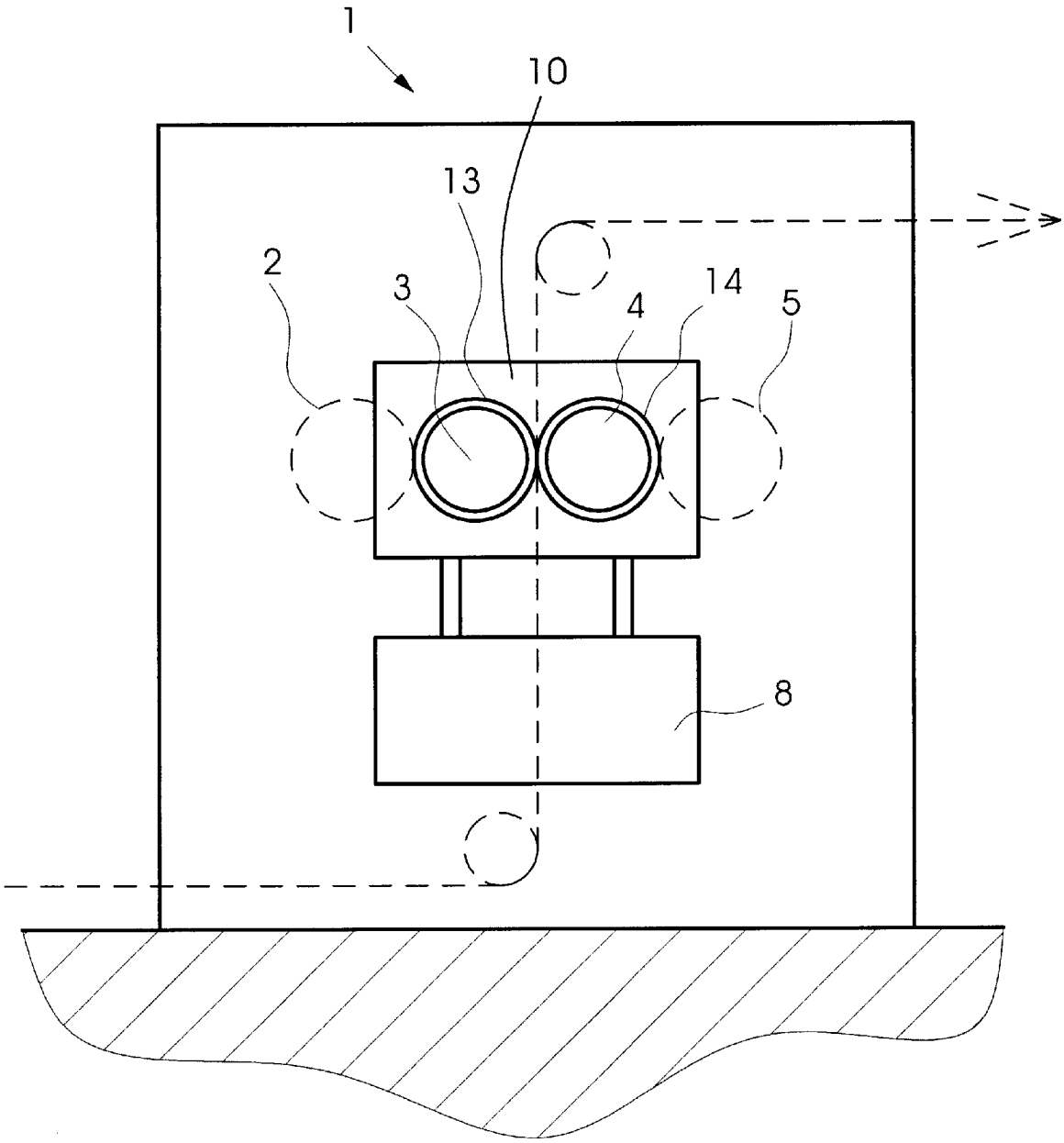
FIG. 1 shows a side view of a print unit of a vertical offset web printing press.

FIG. 1 shows in side view a print unit I of a vertical lithographic offset web printing press. Schematically depicted is a left plate cylinder 2, a left blanket cylinder 3, a right blanket cylinder 4 and a right plate cylinder 5. On the left blanket cylinder 3 is an axially removable blanket 13, which can placed on blanket cylinder 3 in the manner described in U.S. Pat. No. 5,429,048. Right blanket cylinder 4 likewise has an other axially removable blanket 14. During a print operation of print unit 1, a web of material, such as paper, passes through a nip formed between blanket 13 and right blanket 14. A door 8 or two doors, shown schematically in an open position, can open in the side of a frame 9, so as to form an opening to permit the axial removal of blankets 13 and 14. Blankets 13 and 14 however may become sticky or difficult to remove, from imperfections in manufacture, from contamination or even from environmental conditions such as humidity or temperature. It is noted that the blanket cylinders 3 and 4 can be moved so that each is free from contact with any other cylinders.

Figure 2:
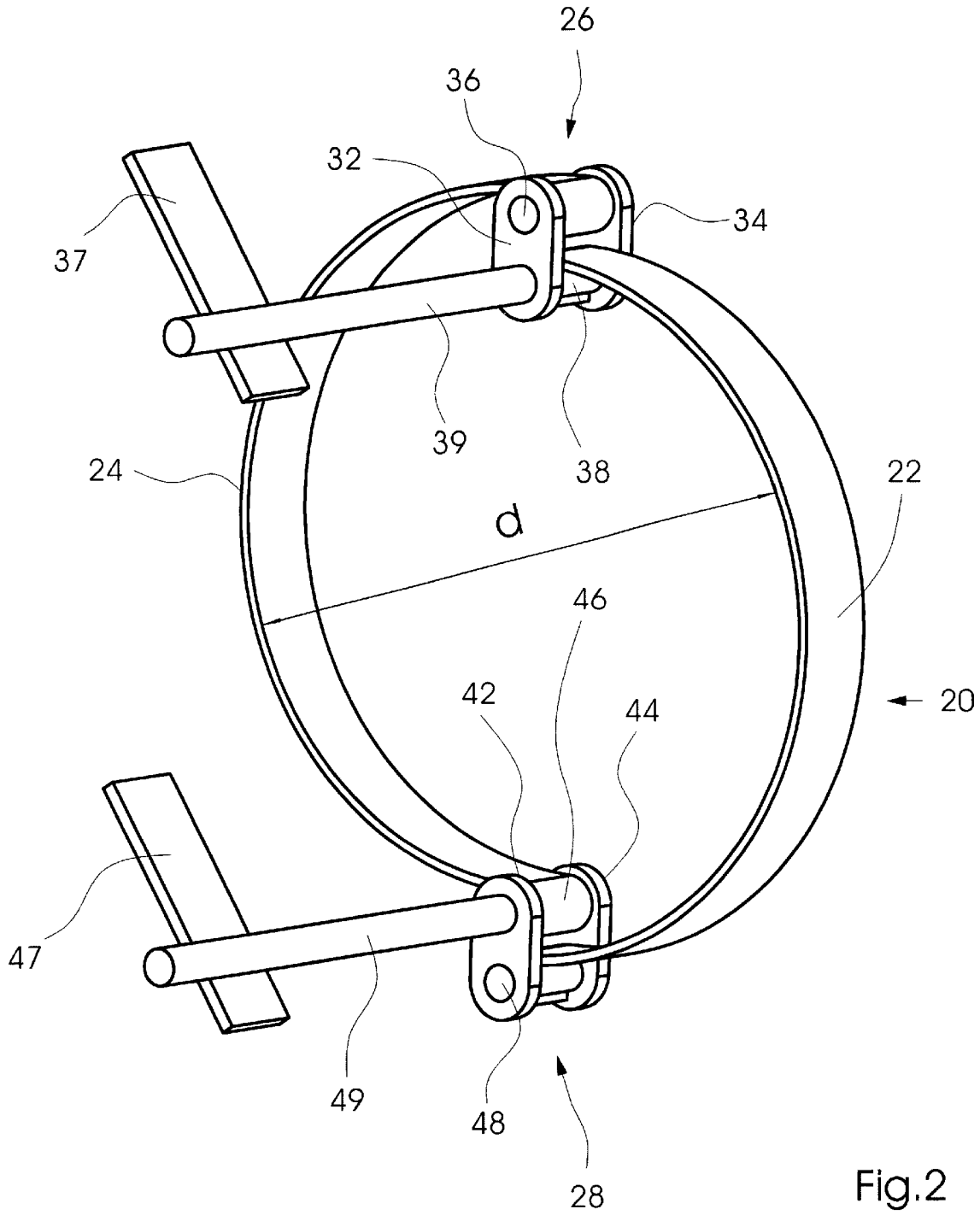
FIG. 2 shows perspective view of a first embodiment of the removal device of the present invention.

FIG. 2 shows a printing sleeve removal device 20 of the present invention to aid in removing printing sleeves such as blankets 13 and 14 when stuck. The embodiment of FIG. 2 includes a first band 22 and a second band 24. The bands preferably are one inch wide and made of 16 gauge steel or other metal. The bands are connected at a first end by a first tightening device 26 and at their other ends by a second tightening device 28.

First tightening device 26 includes a first side plate 32 and a second side plate 34. A first pin 36 and a second pin 38 are non-rotatably fixed between side plate 32 and side plate 34. An actuating rod 39 is connected to or an integral extension of second pin 38. The pins preferably are 0.188 inch in diameter, and the rod has a 0.313 diameter, and may be made of a metal such as steel. The side plates also preferably are made of metal such as steel. The rod is preferably about 15 inches in length. Attached fixedly at another end of the rod 39 is a handle 37.

Similar to tightening device 26, tightening device 28 has a first side plate 42 and a second side plate 44, a first fixed pin 46 and a second fixed pin 48. An actuating rod 49 is attached or integral with first fixed pin 46 and has a handle 47 at the other end.

The removal device 20 forms an effective diameter d when tightening devices 26 and 28 are tightened which matches or is slightly smaller than the outer diameter of the sleeve to be removed. For example the effective diameter may be 7.02 inches to remove a compressible blanket, which has an outer diameter slightly larger than 7.02 inches.

Figure 3:
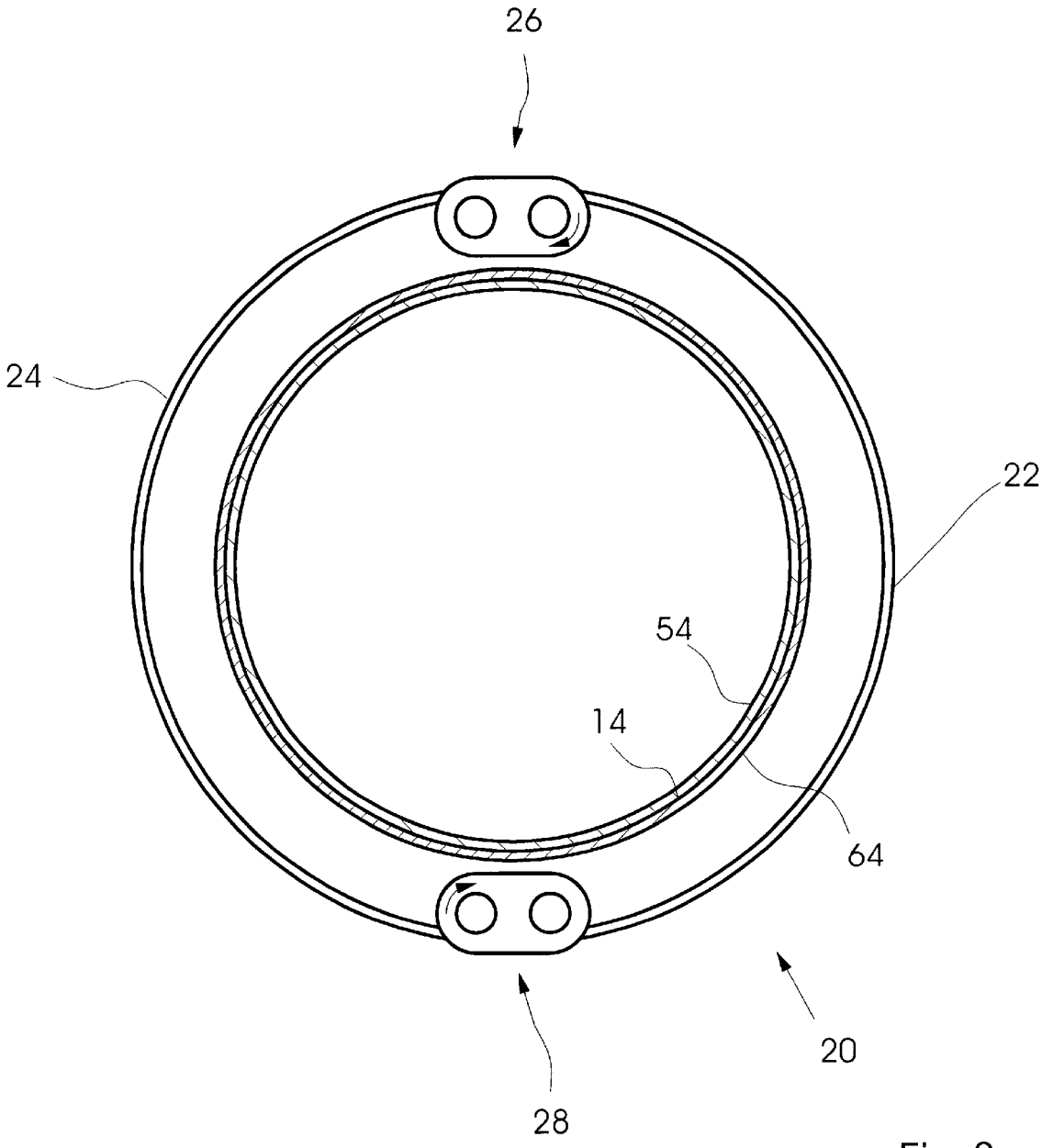
FIG. 3 shows a schematic side view of the placing of the removal device of FIG. 2 over a printing sleeve before tightening.

FIG. 3 shows a schematic side view of the removal device 20 of FIG. 2 in a non-tightened position being placed axially over the blanket 14 of FIG. 1. The blanket may have a compressible layer 64 and an inner tube 54. Compressible layer 64 may be a composite of multiple layers which may include an incompressible material such as rubber without significant voids, and a layer of compressible material such as rubber with voids. The device 20 is placed over blanket 14 by an operator.

Figure 4:
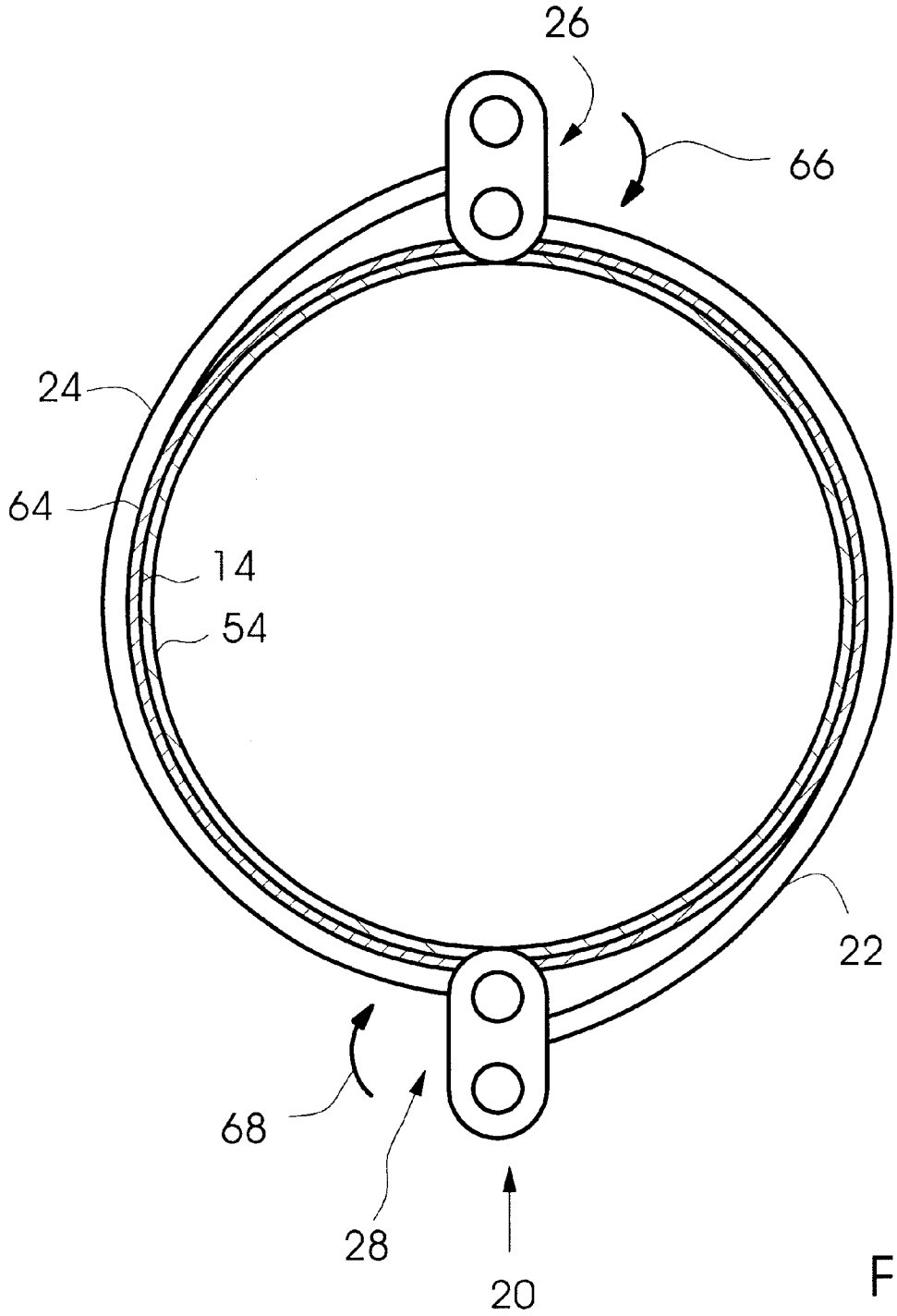
FIG. 4 shows schematic side view of the tightened state of the removal device of FIG. 2 over the printing sleeve.
Figure 5:
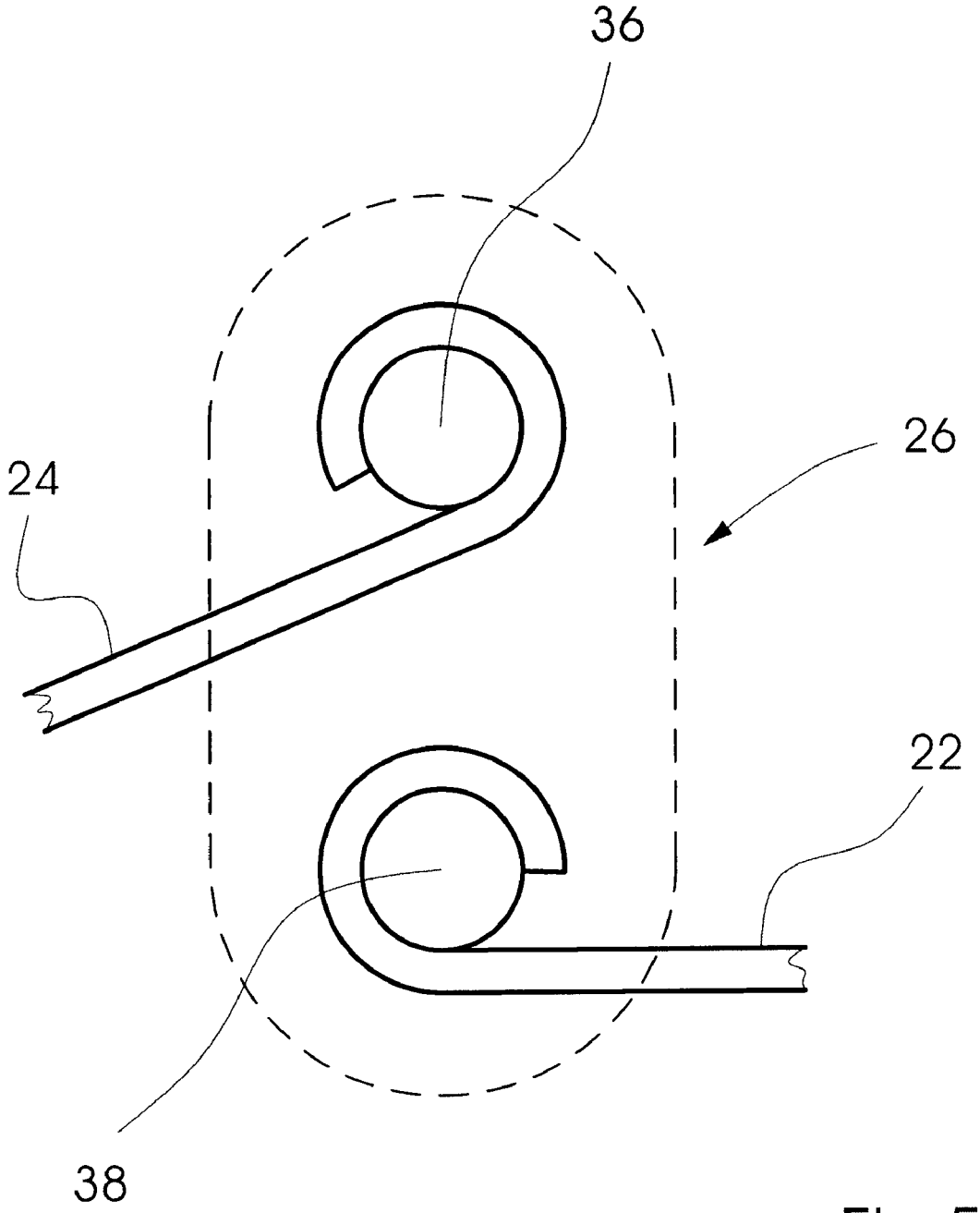
FIG. 5 shows a schematic side view of tightening device of the removal device of FIG. 2.

FIG. 4 shows a schematic side view of the removal device 20 tightened about blanket 14. The first and second tightening devices 26 and 28 are actuated by an operator twisting the handles 37 and 47 of FIG. 2 in the direction of arrows 66 and 68, i.e. clockwise. As shown in FIG. 5, the first band 22 is wrapped around the second pin 38 and is rotatably movable about the pin 38. The second band 24 is also rotatably moveable about second pin 36. Thus the twisting in the clockwise direction of the handle 37 (FIG. 2), which is fixed in relation to the pins and the side plates, causes the tightening device 26 to move from the position shown in FIG. 3 to the position shown in FIG. 4. The effective diameter of the removal device 20 thus is reduced and bands 22 and 24 tighten about the blanket 14. The compressible layer 64 is squeezed, and thus the blanket may be pulled out axially by the operator through the opening 10 shown in FIG. 1. It is noted that the tightening devices 26, 28 could rotate even further in the clockwise direction as desired by the operated to provide and even tighter squeeze by the removal device 20.

Figure 6:
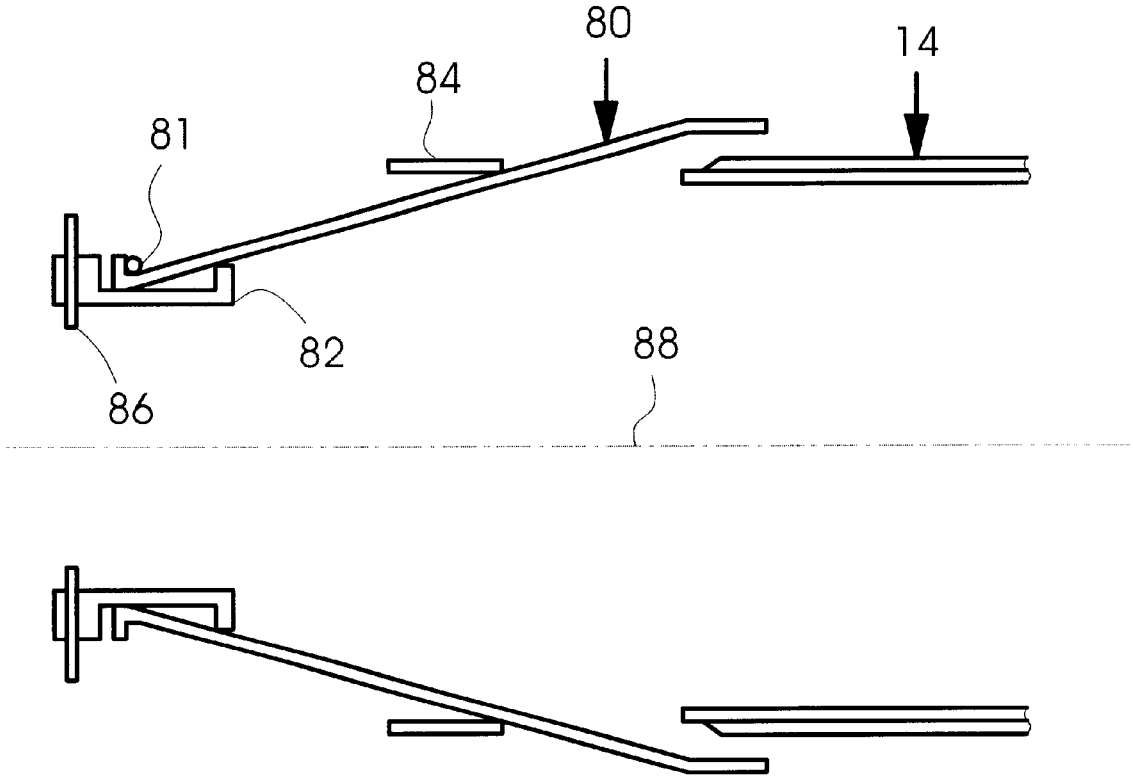
FIG. 6 shows a cross-sectional view of an alternate embodiment of the present invention.

FIG. 6 shows an alternate embodiment of the present invention. A plurality of bands 80 are spaced apart circumferentially about a base ring 82. Each band 80 has an associated spring 81, which forces bands 80 against a slide ring 84. The base ring has pulling rings 86 to pull the base ring toward a press operator. The alternate embodiment functions so that an operator places the bands over the sleeve 14 or blanket and then moves the slide ring 84 or tightening device toward sleeve 14, which has a centerline 88. The bands are thus forced against sleeve 14 and grip sleeve 14. Sleeve 14 may then be removed by the operator by pulling with at least one hand at a pulling ring 86.

While the first embodiment has been described with reference to a two band structure, it is also possible that a single band be used. A printing or print sleeve as used herein may be any type of tube used in a printing press, such as a gapless printing plate or form, or a printing blanket. Moreover, "band" as defined herein can include any elongated structure with any type of cross-sectioned shape, including a rectangular cross-section as described above or a circular cross-section, i.e. cable-like.

Figure 7:
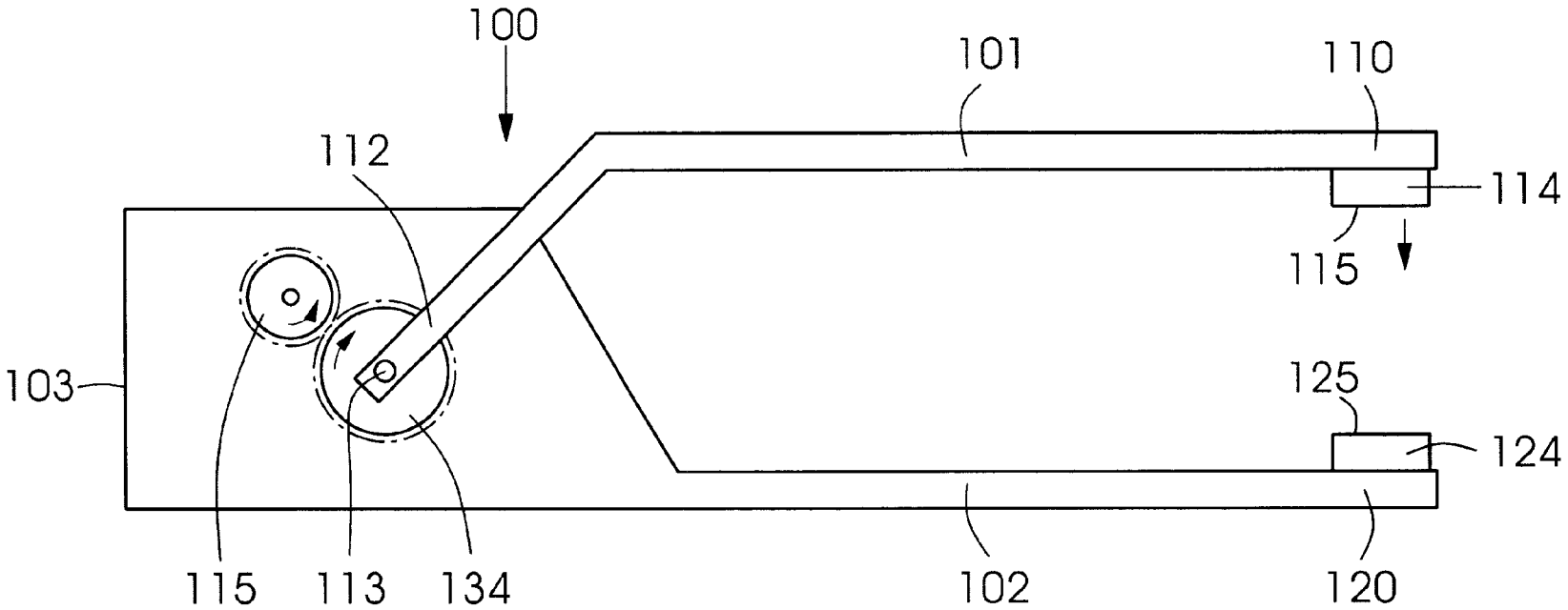
FIG. 7 shows another alternate embodiment of the present invention.

FIG. 7 shows a further embodiment of the present invention: a printing sleeve removal device 100. A first jaw arm 101 has a first end 110 and a second end 112. At first end 110 is a gripping pad 114, having for example a rough inner surface 115. A second jaw arm 102 is integral with a base 103, and has a first end 120, which also has a gripping pad 124 with a friction surface 125. Second end 112 of first jaw arm 101 is fixedly connected by a pin 113 to a gear 134. Pin 113 is rotating supported in base 103. A drive gear 115, also rotating supported in base 103, meshes with gear 134 and is connected for example to an electric motor for driving drive gear 115 in known fashion.

The rotation of gear 115 can thus cause gear 134 to open or close arm 101 with respect to arm 102.

To remove a printing sleeve the jaw arms 101, 102 are inserted about the printing sleeve, for example manually by a press operator through an opening in a work side of the print unit.

Figure 10:
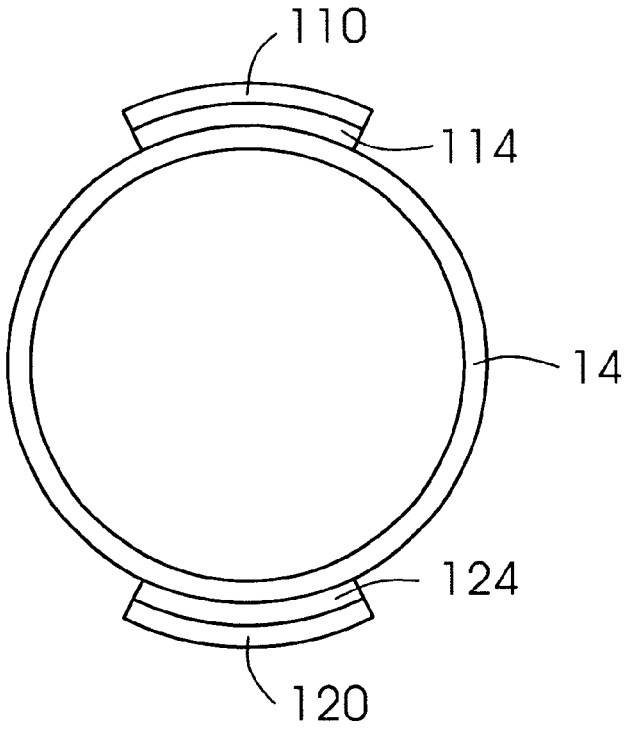
FIG. 10 shows schematically the embodiments of FIGS. 7 and 8 gripping a printing tube.

As shown in FIG. 10, the two ends 110 and 120 of jaw arms 101, 102 respectively, preferably but not necessarily may be curved to match a size of a blanket or printing sleeve 14. The operator can then activate the drive motor, so that pads 114 and 124 grasp the blanket 14 through a counter-clockwise action of drive gear 115, which causes a clockwise rotation of gear 134 and arm 101 about an axis of pin 113.

Alternatively, the printing sleeve removal device as shown in FIG. 7 could be robotically controlled rather than operated by a press operator.

Figure 9:
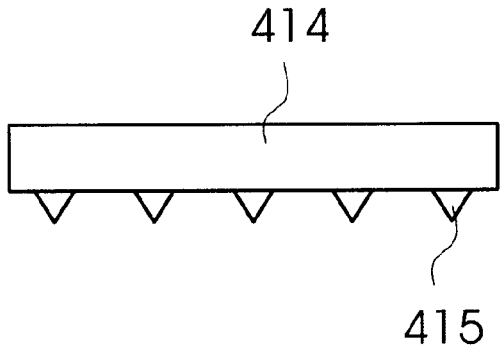
FIG. 9 shows an alternate gripping pad for possible use with the embodiments of FIGS. 7 and 8;.

FIG. 9 shows an alternate pad 414 with teeth 415 which could replace pads 114 and 124. The teeth provide extra gripping and may be especially advantageous for use with blankets, as the teeth can penetrate a rubber layer, and be made for example of a hard elastomeric or metal material.

Figure 8:
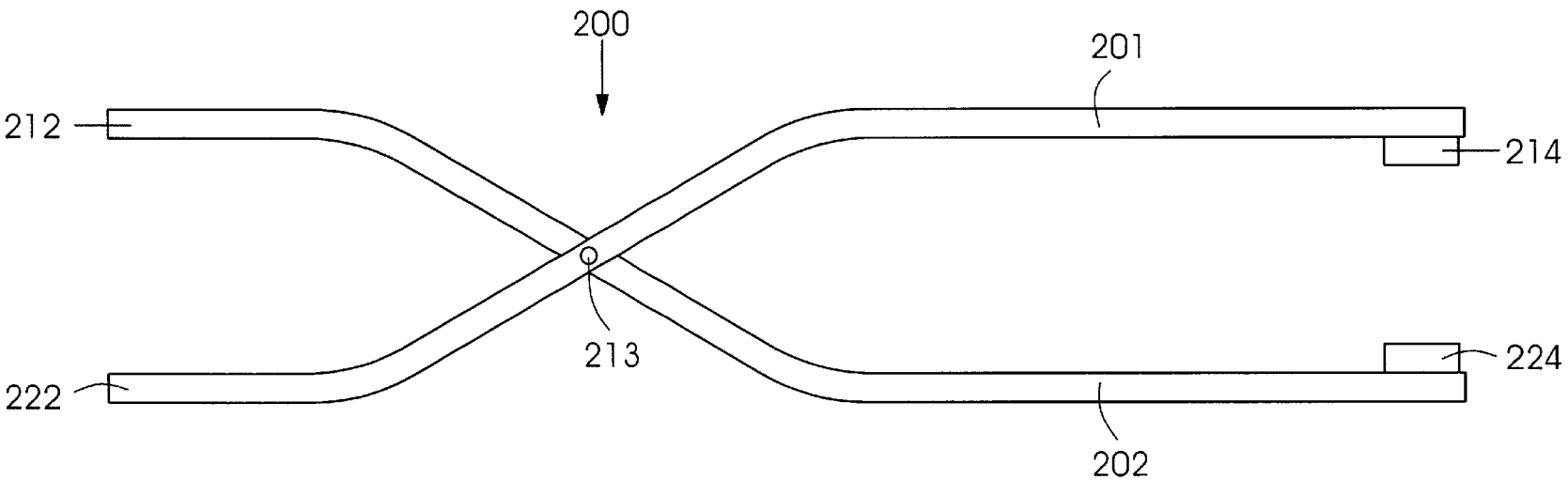
FIG. 8 shows yet another alternate embodiment of the present invention.

FIG. 8 shows another embodiment of a printing sleeve removal device 200 with a first jaw arm 201 rotatable about a pin 213 with a second jaw arm 202. Handles 212 and 222 at respective ends of jaw arms 202, 201 can be gripped by an operator and used to close the jaw at the end of the printing sleeve removal device so as to aid in removing a printing sleeve. Pads 214 and 224 may be provided and may be similar to the pads 114, 124 shown in FIG. 10.

Figure 11:
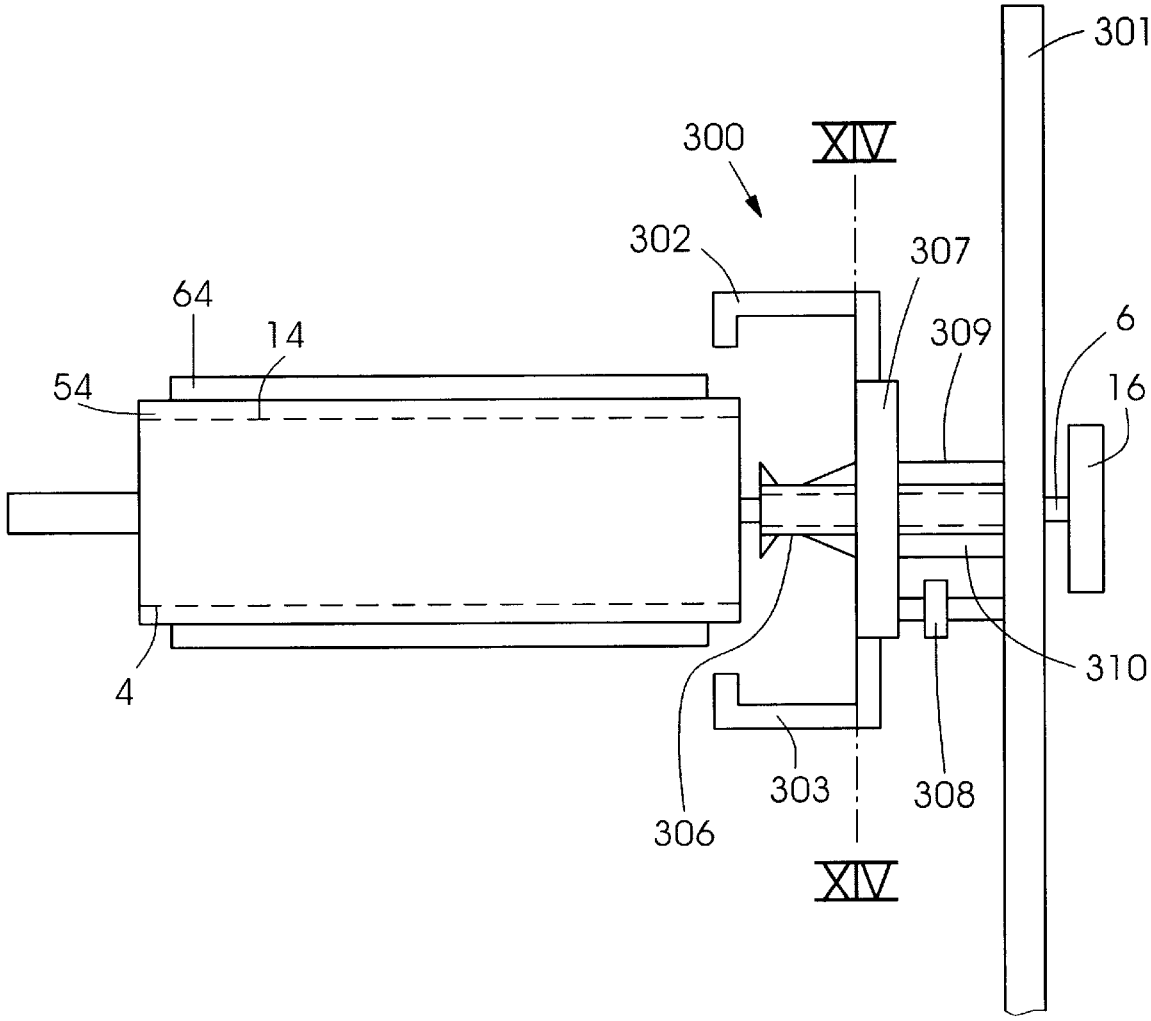
FIG. 11 shows further embodiment of the present invention.

FIG. 11 shows a gear side printing sleeve removal device 300 which may be used in conjunction with the embodiments described in the previous figures, or may be used alone to aid a press operator in removing a printing sleeve. Print unit 1 includes a gear side frame 301 on which a blanket cylinder 4 is supported in cantilevered fashion. On the outer surface of blanket cylinder 4 is a blanket 14 having an inner sleeve 54 on which is a compressible layer 64. Blanket cylinder 4 may be driven by a drive shaft 6 connected to gearing 16.

Gear side removal device 300 includes a guide pipe 306 which is fixed to frame 301 and surrounds drive shaft 6. Drive shaft 6 is free to rotate within guide pipe 306, either through no contact or a bearing arrangement. Slidingly arranged on guide pipe 306 is an actuating disk 307 which can be moved back and forth along guide pipe 306 by one or more pneumatic cylinders 308. Movable radially with respect to actuating disk 307 are two jaw arms 302 and 303. Jaw arms 302 and 303 move radially with respect to the actuating disk 307 by virtue of cams 309, 310, respectively, located on guide pipe 306.

Figure 14:
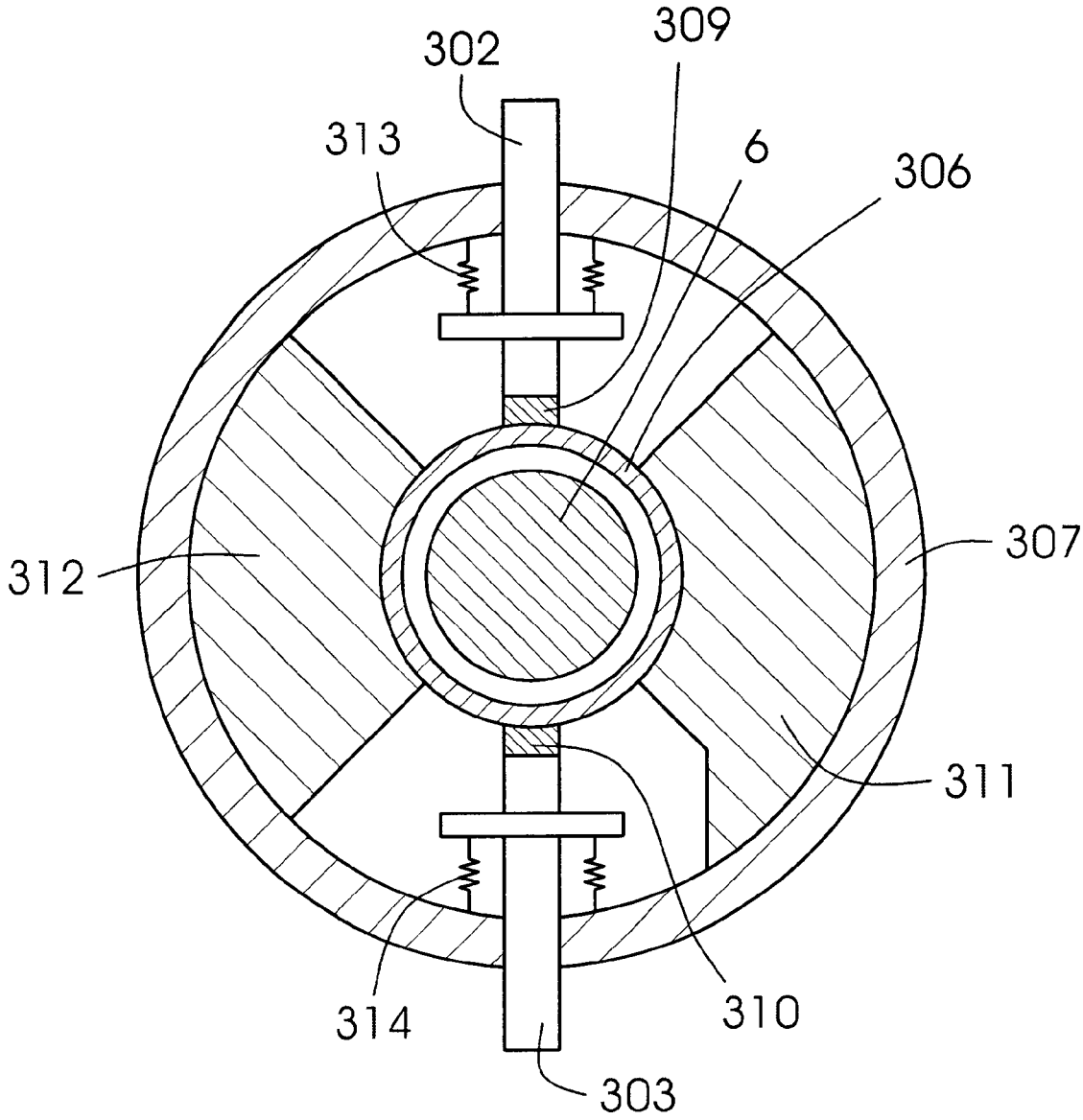
FIG. 14 shows a view of the embodiment of FIG. 11 through section A—A in FIG. 11.

FIG. 14 shows a view of FIG. 11 through section A-A of FIG. 11, and shows drive shaft 6 located within guide pipe 306, which is fixed. Actuating disk 307 slides along guide pipe 306 by sections 311, 312 which are integral or fixed with actuating disk 307. Pneumatic cylinder 308 can act on one of these sections 311, 312 to slide the disk 307. Sections 311,312 may have bearings to aid in reducing friction along pipe 306.

Fixed to the outside of pipe 306 are cams 309, 310, which as shown in FIG. 11 slope downward as the pipe 306 nears blanket cylinder 4. Arms 302 and 303 are forced against cams 309, 310, respectively, by springs 313, 314. Arms 302, 303 may also have bearings to aid in reducing friction.

Figure 12:
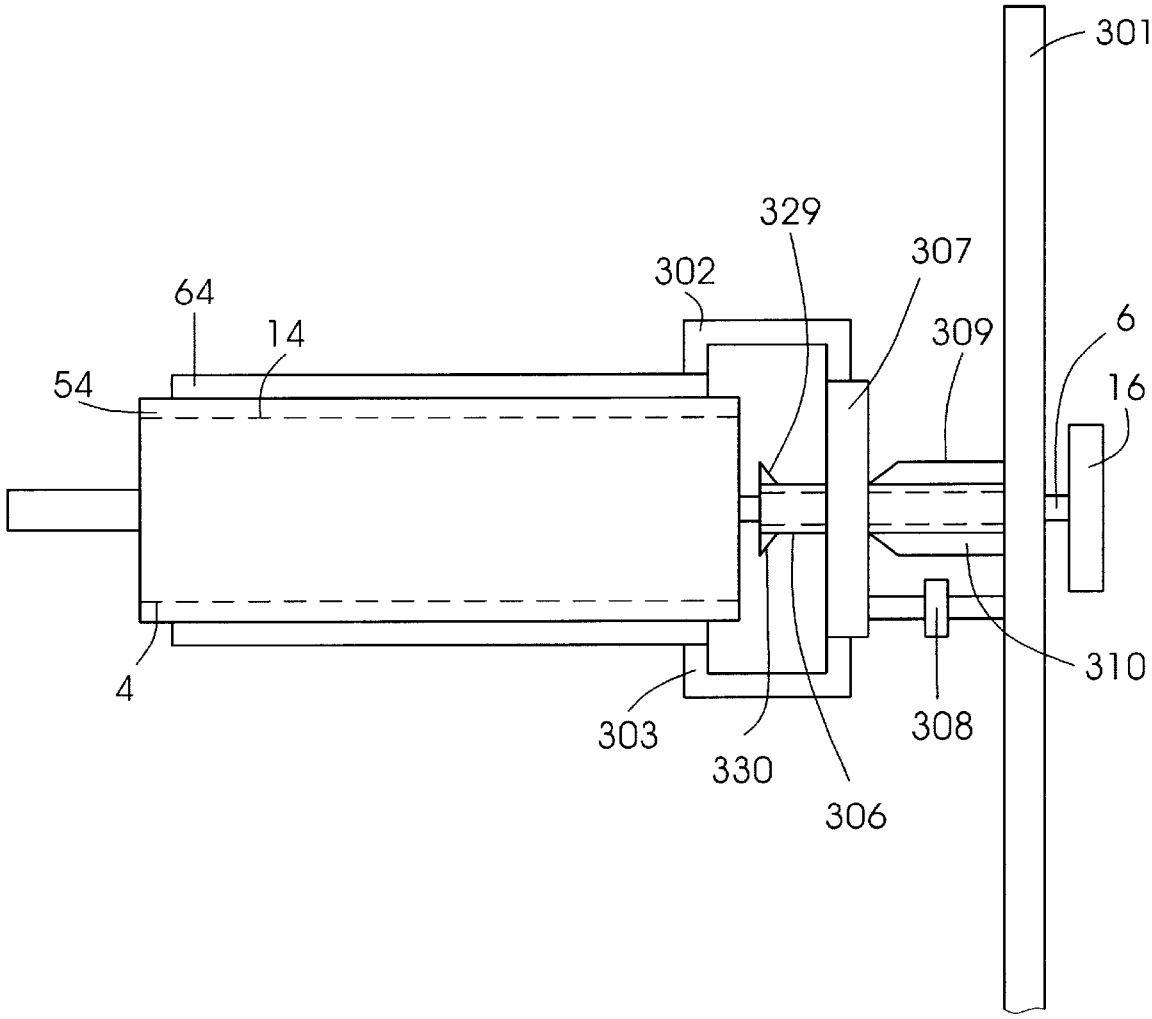
FIG. 12 shows the embodiment of FIG. 11 in a second position.

As shown in FIG. 12, as the cylinder 308 moves the disk 307 towards blanket cylinder 4, the arms 302, 303 move radially inwardly with respect to disk 307 by virtue of the radially inward sloping of cams 309,310. Arms 302,303 thus firmly grasp the blanket 14.

Figure 13:
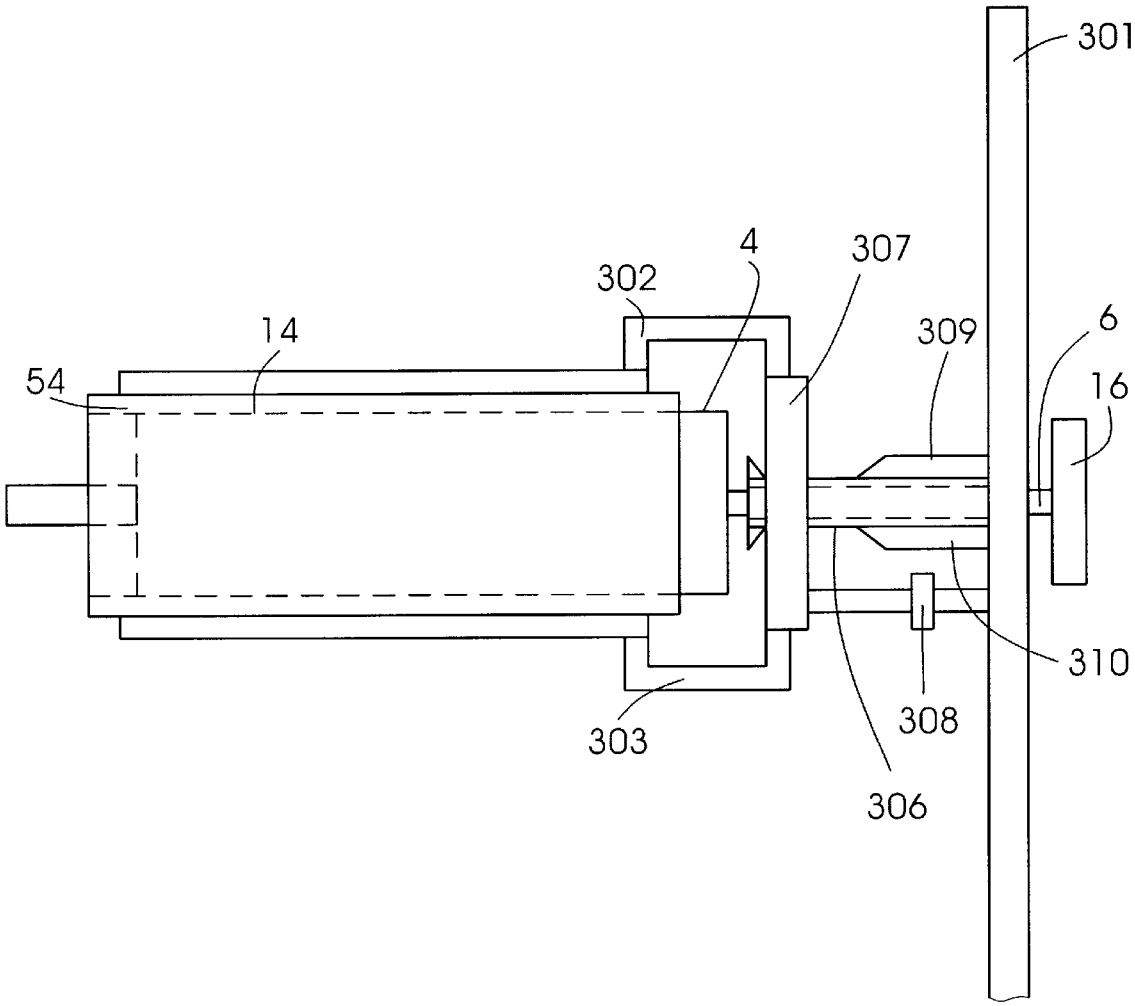
FIG. 13 shows the embodiment of FIG. 11 in a third position.

As shown in FIG. 13, the blanket 14 is then moved off cylinder 4 as the disk 307 is moved further. Cams 309,310 can slope upward at locations 329,330, as shown in FIG. 12, so that arms 302, 303 move upwardly and release the blanket 14. The blanket can then be removed by an operator, either by hand or though use of one of the operator-side tools described in the other embodiments of the present invention.

While the present embodiments have been described in connection with grasping an outside of the printing sleeve, embodiments in which the inside of the printing sleeve is forced outwardly may also be within the scope of the present invention as claimed.

What is claimed is:

1. A printing sleeve removal device comprising:

a first jaw arm;

a second jaw arm movable with respect to the first jaw arm, the first and second jaw arms having ends forming ajar to engage a printing sleeve; and an actuating cylinder to move the first and second jaw arms axially with respect to the printing sleeve.

2. A printing sleeve removal device in combination with a print unit comprising:

a print unit having a gear side; and a printing sleeve removal device having a first jaw arm, a second jaw arm movable with respect to the first jaw arm, the first and second jaw arms having ends forming a jaw to engage a printing sleeve; and an actuating cylinder to move the first and second jaw arms axially with respect to the printing sleeve;

wherein the actuating cylinder is attached to the gear side.

3. A printing sleeve removal device in combination with a printing sleeve comprising:

a printing sleeve; and a printing sleeve removal device having a first jaw arm and a second jaw arm movable with respect to the first jaw arm, the first and second jaw arms having ends forming a jaw to engage a printing sleeve, wherein the printing sleeve is a blanket.

4. A method for removing a printing sleeve comprising:

engaging a printing sleeve on a printing cylinder with a first jaw arm and a second jaw arm of a first printing sleeve removal device;

moving the printing sleeve via the first and second jaw arms so as to slide the printing sleeve axially with respect to the printing cylinder; and grasping the printing sleeve on an operator side with a second printing sleeve removal device.

5. A method for removing a printing sleeve comprising:

engaging a printing sleeve on a printing cylinder with a first jaw arm and a second jaw arm; and moving the printing sleeve via the first and second jaw arms so as to slide the printing sleeve axially with respect to the printing cylinder;

wherein the engaging step includes manually moving the first and second jaw arms with respect to each other.

6. A method for removing a printing sleeve comprising:

engaging a printing sleeve on a printing cylinder with a first jaw arm and a second jaw arm; and moving the printing sleeve via the first and second jaw arms so as to slide the printing sleeve axially with respect to the printing cylinder;

wherein the engaging step includes driving a gear to move the first and second jaw arms with respect to each other.

* * * * *

UNITED STATES PATENT AND TRADEMARK OFFICE

CERTIFICATE OF CORRECTION

PATENT NO. : 6,386,103 B1
DATED : May 14, 2002
INVENTOR(S) : Charette et al.

It is certified that error appears in the above-identified patent and that said Letters Patent is hereby corrected as shown below:

Column 7,
Line 22, "ajar" should read -- a jaw --.

Signed and Sealed this

Sixteenth Day of July, 2002

*Attest:*

*Attesting Officer*

JAMES E. ROGAN
*Director of the United States Patent and Trademark Office*